United States Patent [19]

Coe

[11] Patent Number: 4,664,576

[45] Date of Patent: May 12, 1987

[54] APPARATUS AND METHOD FOR HANDLING CARGO CONTAINER CHASSIS

[76] Inventor: Donald R. Coe, 18720 SE. Yamhill, Portland, Oreg. 97233

[21] Appl. No.: 873,258

[22] Filed: Jun. 6, 1986

Related U.S. Application Data

[63] Continuation of Ser. No. 597,452, Apr. 5, 1984, abandoned.

[51] Int. Cl.[4] ..... B66F 9/18

[52] U.S. Cl. ..... 414/55; 414/120; 414/607; 414/620; 414/621; 414/724; 414/912

[58] Field of Search ..... 414/24.5, 24.6, 607, 414/608, 620, 678, 732, 724, 758, 763, 771, 776, 783, 785, 912, 786, 621, 739, 55, 120; 280/33.99 T, 401

[56] References Cited

U.S. PATENT DOCUMENTS

| | | | |
|---|---|---|---|
| 3,356,238 | 12/1967 | Aldred | 414/621 X |
| 3,589,540 | 6/1971 | Kinross | 414/608 |
| 3,984,019 | 10/1976 | Brudi et al. | 414/917 X |
| 4,014,447 | 3/1977 | Whiteman et al. | 414/607 |
| 4,134,503 | 1/1979 | Baker | 414/372 |
| 4,411,573 | 10/1983 | Townsend | 414/24.6 |
| 4,439,094 | 3/1984 | Riley | 414/732 X |
| 4,459,075 | 7/1984 | Eichenberger | 414/24.5 |
| 4,600,350 | 7/1986 | Matthewson et al. | 414/783 X |

OTHER PUBLICATIONS

"Upender Clamp Attachment", Clark Equipment Company, Battle Creek, Mich., 12-19-49.

*Primary Examiner*—Frank E. Werner
*Assistant Examiner*—Janice Krizek
*Attorney, Agent, or Firm*—Chernoff, Vilhauer, McClung & Stenzel

[57] ABSTRACT

Apparatus attachable to the front end of a vehicle having a lifting apparatus for moving a load vertically, in which a pair of arms are each pivotably mounted on a main carrier which is rotatable about a horizontal transverse axis, for holding a cargo container chassis by engaging its longitudinal frame members, to raise and carry the chassis and to overturn it to an inverted position by rotation of the main carrier about the horizontal transverse axis, which is parallel to the longitudinal axis of the chassis. The attachment is used to stack or unstack cargo container chassis to reduce the amount of container yard space necessary for parking chassis not in use. The load-carrying arms include fixed and movable jaws to help hold the chassis. Only one load-carrying arm can move at a time, and only when the main carrier is in a safe position. The attachment is hydraulicly driven and may include its own engine or receive pressurized fluid from the vehicle on which it is mounted.

12 Claims, 10 Drawing Figures

APPARATUS AND METHOD FOR HANDLING CARGO CONTAINER CHASSIS

This application is a continuation of application Ser. No. 597,452, filed Apr. 5, 1984, now abandoned.

BACKGROUND OF THE INVENTION

The present invention relates to apparatus and a method for lifting and rotating a large elongate object such as a trailer chassis used to carry intermodal cargo containers during highway transit, about a horizontal axis parallel with the longitudinal axis of the object.

In recent years a growing share of cargos transported by sea or rail are being shipped by intermodal transport. Such cargo is packed by shippers in large rectangular containers which can be carried in specially designed ships, on railroad flat-cars, or on special trailer chassis which are hauled over the highways by truck tractors, as if they were ordinary fixed body semi-trailer cargo vans.

At seaports and major railheads, cargo containers are removed from their respective highway trailer chassis and loaded upon ships or flatcars for ocean or rail transportation, leaving the container chassis empty at least temporarily. Because of the high cost of land in area such as ocean freight terminals and railroad yards, it is highly desirable to minimize the amount of land required for parking empty cargo container chassis. Nevertheless, it is important to have a sufficient number of cargo container chassis conveniently available in such locations to accept and carry cargo containers as they are unloaded from railroad flatcars and, more importantly, from container ships which may carry over 2,000 of such containers.

In the past, heavy-duty fork-lift vehicles and chains have been used to lift and overturn the chassis, so that they may be stacked one upon another, alternatingly upright and upside down. Such inversion and stacking of trailer chassis by the use of forklift vehicles saves land. However, it requires the coordinated efforts of several people and is awkward and dangerous. The practice is also costly, in terms of personnel time and of the damage often experienced by chassis being stacked in such a manner.

Repairs to container chassis frequently require work such as welding to be done from awkward positions when a chassis is located upright in a repair shop, although the repairs could be made much more easily with the chassis on its side or upside down. The difficulty of placing a chassis on its side or upside down, however, has usually been even greater than that of performing the repair work awkwardly.

Efforts have been made previously to provide more convenient storage of cargo trailer chassis. In one storage system, for example, a machine engages the rear end of a container chassis and raises the front end in order to store the chassis in a leaning, nearly vertical position with the front end resting against a large stationary rack, reducing the amount of land required for each individual chassis. The racks of such a system, however, are very expensive, and are difficult to remove.

Another type of apparatus engages the chassis from one side, permitting the chassis to be raised vertically several feet and then rotated about a horizontal axis extending transversely of the chassis, thus rotating the chassis end-for-end. As with standing the trailer chassis nearly vertically, this method and apparatus for inverting the chassis requires a vertical clearance at least as high as the length of the chassis, ordinarily about 40 feet. Additionally, rotating the chassis in this fashion moves the ends of the chassis long distances, and is therefore both awkward and potentially very dangerous.

What has been needed, therefore, is apparatus and a method for more safely, cheaply, and easily inverting and stacking or unstacking cargo container chassis, to facilitate repair work and to permit chassis to be stored in stacks, yet be easily, safely, and quickly unstacked to be used to carry cargo containers as they are unloaded from a ship or railroad train.

SUMMARY OF THE INVENTION

The present invention provides an attachment for heavy-duty forklift vehicles and the like and a method for its use to handle large elongate objects, particularly to lift, overturn, carry, stack, and unstack truck trailer chassis designed to carry intermodal transport cargo containers. The present invention thus enables such chassis to be stored on a greatly reduced area of cargo terminal land, and overcomes the major disadvantages of the previously used methods and apparatus for stacking such cargo container chassis.

The chassis-handling apparatus of the present invention may be mounted on the vertically movable portion of the front or load-carrying end of a vehicle such as a heavy-duty forklift vehicle, and may then be used to grasp, rotate, lift, and place such a trailer chassis in a desired position. The apparatus is potentially useful in seaport container ship terminals, railroad yards, shipping and trucking company terminals, and in repair shops and transfer yards associated with such organizations and port facilities.

The apparatus of the invention includes a frame adapted to be carried on vertically movable fork arms located at the forward or load-carrying end of a forklift truck or on certain specialized machines intended for use in upending cargo container chassis by engaging the rear ends of the longitudinal frame members of such chassis. The apparatus can be raised and lowered by the vertically movable load-carrying portion of such a lift truck.

Mounted on the frame of the chassis-handling apparatus is a cradle including a main carrier which is rotatable about a horizontal transverse axis. Mounted thereon are a pair of movable arms which extend preferably generally parallel with one another, perpendicular to the axis of rotation of the main carrier, in carrying a load. The arms are used to grasp a cargo container chassis by gripping the longitudinal frame members of the chassis near the longitudinal balance point of the chassis. A movable jaw located on each of the arms opposes a fixed jaw at the outer end of the arm to restrict movement of the longitudinal frame members of the chassis with respect to each of the arms during handling of the chassis.

Each of the load-carrying arms is movable away from its normal closed, or load-carrying, position parallel with the other hand-carrying arm, to a position facilitating placement of the apparatus for engaging a cargo container chassis or disengaging itself from a cargo container chassis. The load-carrying arms are movable only singly and only when the main carrier is in one of the two load-engaging and disengaging positions of rotation about its horizontal axis. This prevents the machine from inadvertently disengaging a cargo container chassis during rotation.

The apparatus of the invention is normally hydraulically powered, and in a preferred embodiment uses the hydraulic fluid supply and pump normally available on a forklift vehicle. In an alternative embodiment an auxiliary power supply and hydraulic fluid pressure system may be provided on the apparatus of the invention to permit the apparatus to be used on lift vehicles unable to provide an adequate supply or pressure of hydraulic fluid.

The present invention also provides a method for handling container chassis in which the apparatus of the present invention, or its equivalent, is used to grasp a cargo container chassis near its balance point, lift the chassis clear of the ground or other obstructions, rotate the chassis approximately 180° about an axis of rotation parallel with the horizontal longitudinal axis of the chassis, move the chassis to a desired location, and thereafter lower the chassis in the desired location.

The method and apparatus of the present invention greatly increase the safety of personnel and reduce the amount of damage to the chassis being handled, by maintaining more positive control over the movement of the chassis than has been possible using the previously available equipment and methods. Since each chassis is rotated about its longest axis rather than an axis which perpendicularly intersects the longest axis, the smallest possible moment of inertia is involved in rotation of a chassis. Additionally, since the amount of vertical clearance required to rotate a chassis about its longitudinal axis is less than that required to rotate it about its transverse axis, the apparatus and method of the present invention may be used inside buildings and in locations where there is too little vertical clearance beneath electrical cables and the like for safe use of the previously available apparatus.

It is therefore a primary object of the present invention to provide apparatus and a method for rotating large elongate objects such as cargo container trailer chassis about a horizontal longitudinal axis of rotation.

It is another important object of the apparatus of the present invention to provide apparatus for inverting, stacking, and unstacking cargo container trailer chassis in container yards and similar places.

It is an important feature of the apparatus of the present invention that it includes a cradle having a pair of load-carrying arms pivotably mounted on a rotatable main carrier for grasping and rotating a cargo container chassis about its longitudinal axis.

It is another important feature of the present invention that it provides a control system which permits rotation of a load only when the load-carrying arms of the cradle are in position to grasp and retain a load and prevents the load-carrying arms from moving relative to one another except when the main carrier is in a predetermined position.

It is a primary advantage of the present invention that it provides a method for handling large elongate objects such as cargo container trailer chassis with greatly improved safety.

It is another important advantage of the present invention that it provides apparatus by which a single person can invert and stack or unstack cargo container trailer chassis much more quickly than has previously been possible.

It is a further advantage of the present invention that it provides apparatus and a method by which cargo container trailer chassis and similarly cumbersome objects can be handled with much less resulting damage than has been possible previously.

It is yet another advantage of the present invention that it provides apparatus which requires much less room in which to overturn cargo container chassis than the methods and apparatus previously used.

The foregoing and other objectives, features and advantages of the present invention will be more readily understood upon consideration of the following detailed description of the invention taken in conjunction with the accompanying drawings.

DETAILED DESCRIPTION OF THE INVENTION

Figures 1, 2:
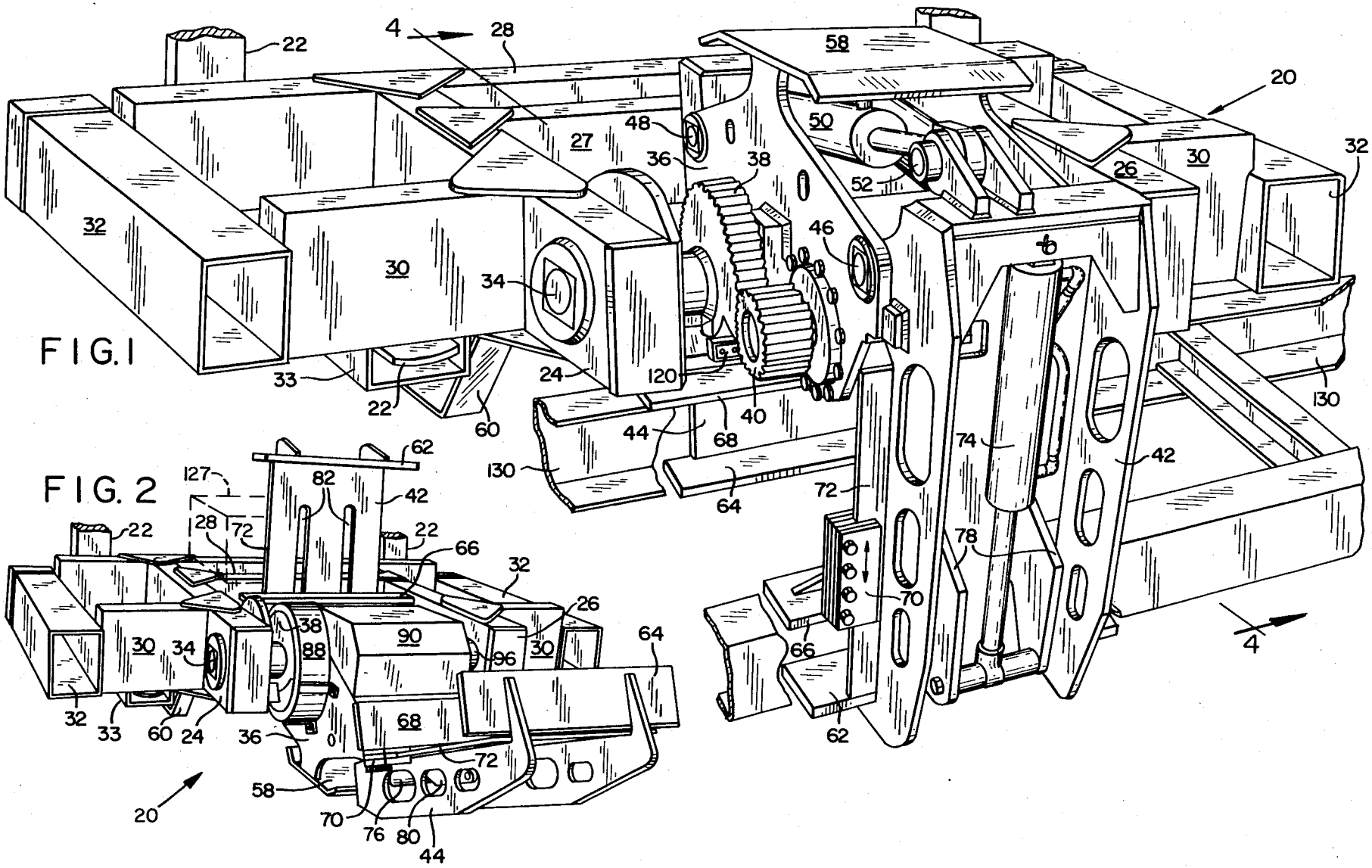
FIG. 1 is a perspective view of apparatus for handling cargo container trailer chassis with its cradle engaging an inverted cargo container trailer chassis, taken from the right upper front of the apparatus.
FIG. 2 is a perspective view of the chassishandling apparatus shown in FIG. 1, showing the cradle in its upright position and one of the load-carrying arms pivoted to the lowered position to facilitate inserting the apparatus under the longitudinal frame members of a cargo container chassis.

Referring now to the drawings, an exemplary chassis-handling apparatus 20 embodying the present invention is shown in FIG. 1 supported on the arms 22 of the vertically movable load-carrying portion of a heavy-duty forklift vehicle (not shown). Such a vertically movable portion is normally located on a lift truck at what will herein be called its forward end, meaning that the lift truck or similar vehicle can be moved directly toward or away from that end. The chassis-handling apparatus 20 has a frame including a right longitudinal frame member 24, a parallel left longitudinal frame member 26, a central transverse member 27, and a rear transverse member 28 which extends horizontally when the chassis handling apparatus 20 is mounted for use on a forklift vehicle or the like. A pair of side members 30 extend laterally outward from the longitudinal frame members 24 and 26 and are fixedly attached at their outer ends to box members 32 located parallel with the longitudinal members 24 and 26. The side members 30 rest atop the forklift arms 22 to support the apparatus 20 on a forklift vehicle, with pockets 33, attached to the side members 30 and the rear member 28, locating the apparatus 20 with respect to the arms 22. Safety chains (not shown) are preferably used to prevent the apparatus 20 from inadvertently sliding off the arms 22. The box members 32 are of an appropriate size and location to receive the lifting arms of an apparatus designed to upend cargo container trailer chassis, to permit use of the present apparatus on such a machine.

A transverse horizontal main shaft 34 extends between and is carried by the left and right longitudinal members 24 and 26. A cradle portion used to lift and rotate loads includes a main or central carrier 36 which is rotatably carried upon the shaft 34, between the left and right longitudinal members 24 and 26 of the frame of the chassis handling apparatus 20.

A gear sector 38 is fixedly attached to the right longitudinal member 24, concentric with the shaft 34. A drive pinion 40, associated with the main carrier 36, is meshed with the gear sector 38.

A pair of load-carrying arms, an inner load-carrying arm 42, and an outer load-carrying arm 44, are pivotably attached to the main carrier 36 at respective inner and outer ends thereof. The load-carrying arms 42 and 44 are pivotable with respect to the main carrier 36 about respective pivot shafts 46 and 48, which extend parallel with the main shaft 34.

Figure 4:
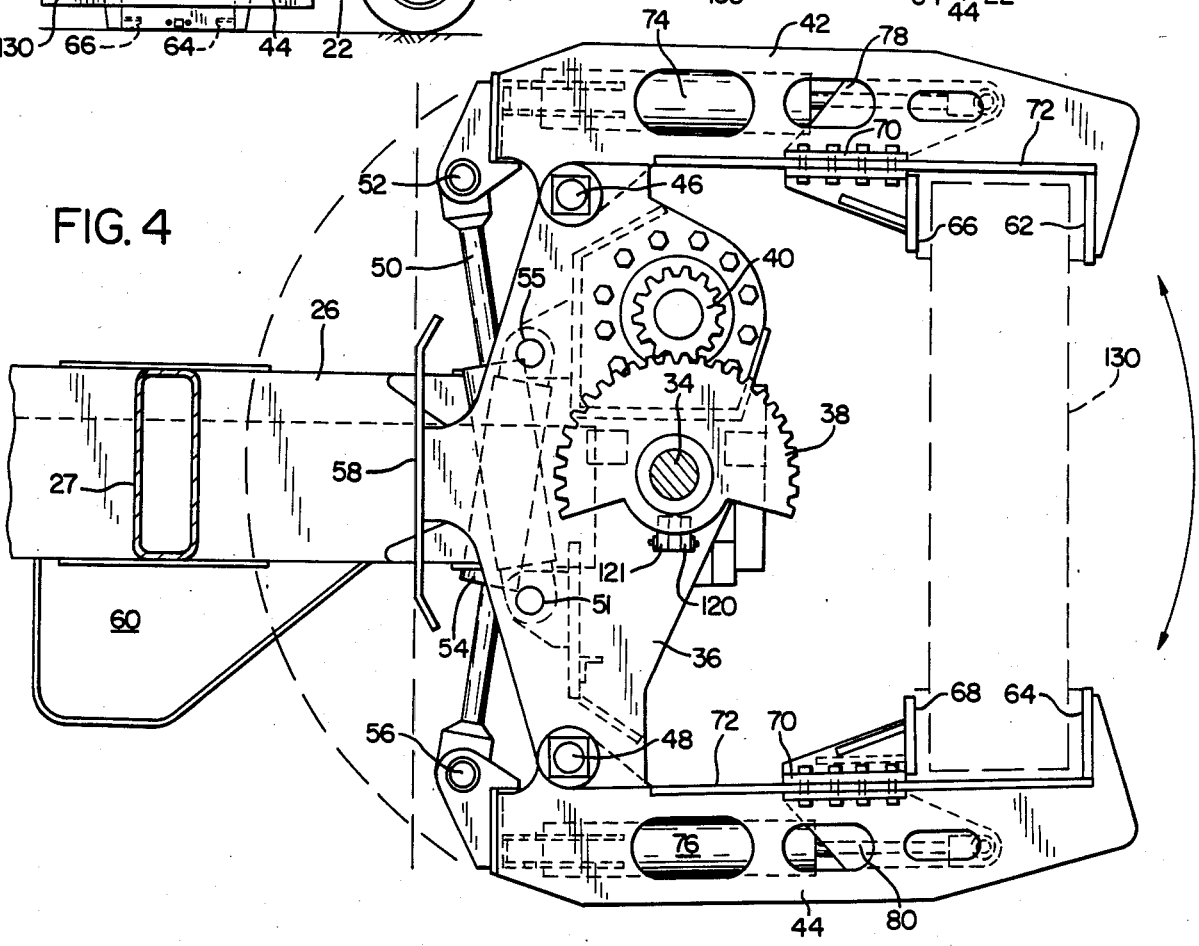
FIG. 4 is a sectional view of the apparatus shown in FIG. 1, taken along line 4—4, showing the cradle in an intermediate position of rotation.
Figure 5:
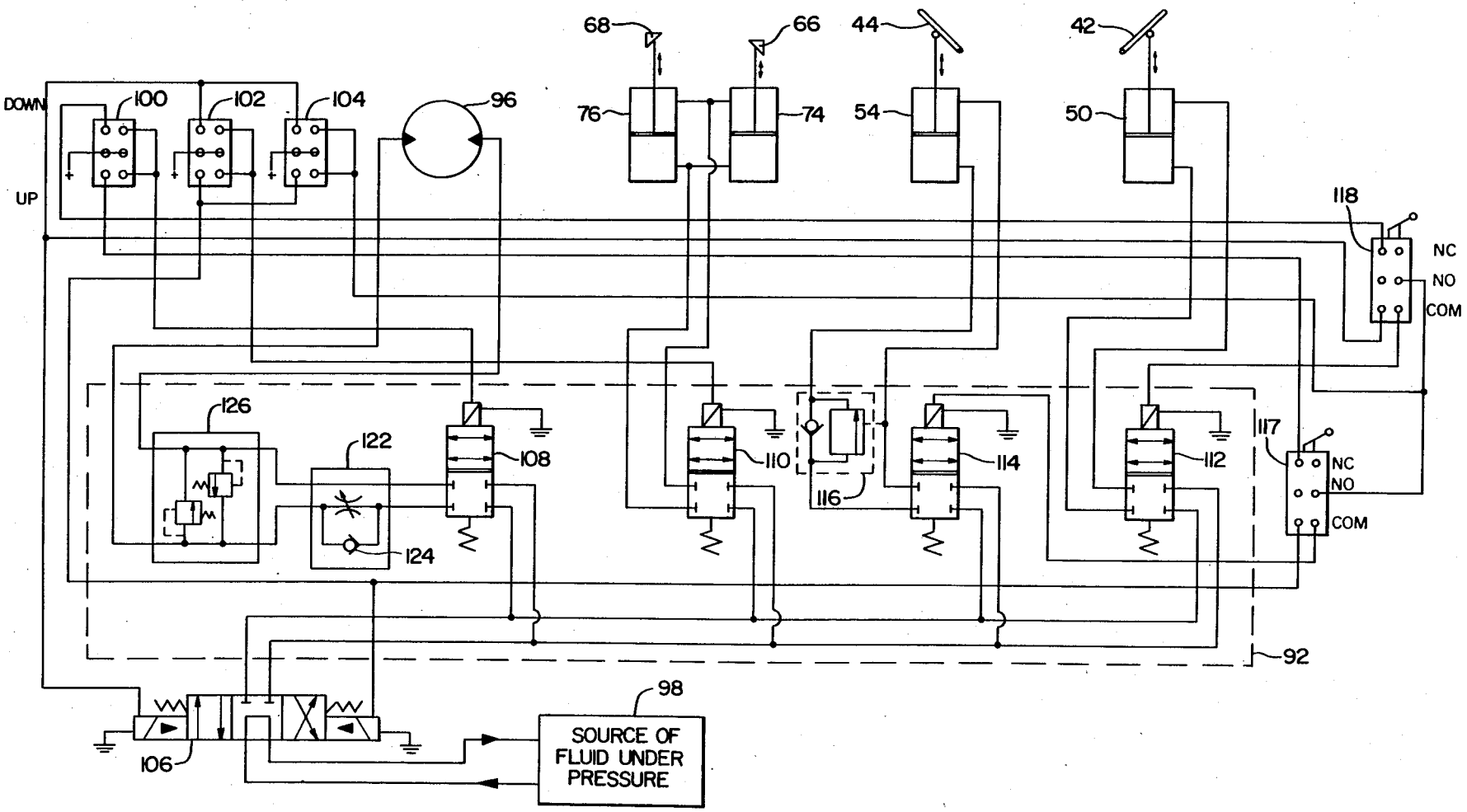
FIG. 5 is a schematic view showing the control system and power system for operating the apparatus shown in FIG. 1.

The ends of a linear motor such as a double-acting hydraulic cylinder and piston assembly 50 are pivotably attached, respectively, to a pivot joint 51 (FIG. 4) located on the main carrier 36 and a pivot joint 52 located on the inner end of the inner load carrying arm 42. A similar linear motor such as the hydraulic cylinder and piston assembly 54 is attached similarly to a pivot joint 55 (FIG. 4) on the main carrier 36 and to a pivot joint 56 on the outer load-carrying arm 44.

A skid pan 58 protects the hydraulic cylinder and piston assemblies 50 and 54 and acts as a support for the main carrier 36 when it is in its upright position, as shown in FIG. 2. A pair of skids 60 located beneath and fixedly attached to the bottoms of the right and left longitudinal members 24 and 26 act together with the protective pan 58 as a tripod to support the chassis handling apparatus 20 on the ground when it is not mounted upon a vehicle for use.

The load-carrying arms 42 and 44 are equipped with outer jaws 62 and 64 which are fixedly located at the respective outer ends of the load carrying arms 42 and 44. Additionally, a movable jaw 66 is located on the inner load carrying arm 42, and a movable jaw 68 is located on the outer load carrying arm 44. The movable jaws 66 and 68 are each attached by slides 70 to slideways 72 extending along the load-carrying arms 42 and 44. The movable jaws 66 and 68 are movable along the slideways 72 by respective linear motors, such as double acting hydraulic cylinder and piston assemblies 74 and 76, located, respectively, on the load-carrying arms 42 and 44. The cylinder and piston assemblies 74 and 76 are connected pivotably to the respective load-carrying arms, and each is also pivotably attached to a respective pair of legs 78 or 80 which extend rearwardly from the movable jaws 66 and 68 through slots 82 and 84 defined in the load-carrying arms 42 and 44. The movable jaws 66 and 68 can thus be moved between retracted positions and closed positions adjacent the frame members of a chassis being handled by the apparatus 20.

Figure 3:
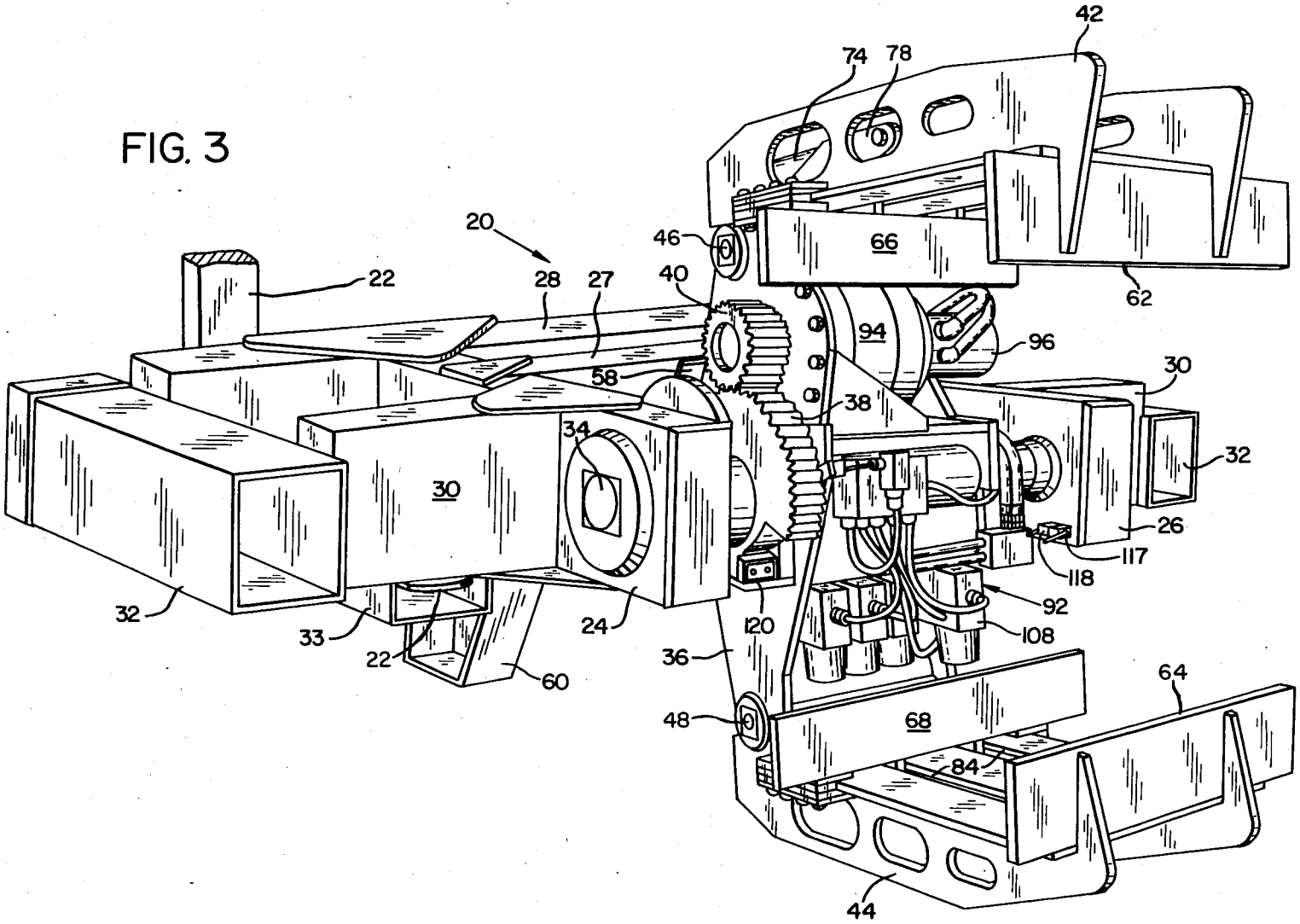
FIG. 3 is a perspective view taken from the upper right front of the apparatus shown in FIG. 1, showing the cradle in an intermediate position of rotation.

As may be seen in FIG. 2, shields 88 and 90 may be provided to protect the gear sector 38, the pinion 40, and a set of control valves 92, which are visible in FIG. 3. In FIG. 3, the apparatus is shown with the cradle rotated to an intermediate position between the upright position shown in FIG. 2 and the inverted position shown in FIG. 1, and the shields 88 and 90 are omitted to disclose the locations of the set of control valves 92.

Referring still to FIG. 3, it may be seen that the drive pinion 40 is driven by the output shaft of a reduction gear assembly 94 which, in turn, is driven by a bidirectional rotary hydraulic motor 96. The rotary hydraulic motor 96 may be, for example, a Ross Torqmotor, model MAE-10016, rated at 7 horsepower under 1200 psig pressure, which is available commercially from the Ross Gear Division of TRW, of Lafayette, Ind. The reduction gear 94 may, for example, be a planetary reduction gear unit having a speed reduction ratio of about 55:1 and an output torque rating of 75,000 inch-pounds, such as the model No. S3A6-2-4-55 reduction gear assembly available from Fairfield Manufacturing Co., Inc. of Lafayette, Ind.

In a preferred embodiment of the present invention, the chassis handling apparatus 20 is hydraulically powered. As described herein, the apparatus 20 requires hydraulic fluid to be available in quantities of up to 20 gallons per minute at a pressure of at least 1200 psig. The source 98 of pressurized fluid may be the hydraulic pump system carried on a heavy duty forklift vehicle suitable for carrying the chassis-handling apparatus 20 of the present invention. Pressurized fluid may be made available through a connection into the hydraulic pressure system of the forklift vehicle on which the apparatus 20 is mounted for operation. For example, the apparatus of the present invention is compatible with a forklift vehicle having a capacity of at least 15,000 pounds, such as the Model H-150 forklift truck manufactured by Hyster Corporation of Portland, Oreg.

Operation of the apparatus 20 is controlled by means of three double-pole, double-throw, toggle switches 100, 102, and 104, each biased to a normally-open circuit condition. The switches cooperatively control a normally-closed solenoid-operated direction control valve 106 and four normally closed spring-loaded solenoid-operated control valves 108, 110, 112, and 114. Holding any of the switches 100, 102, and 104 in one of the closed circuit positions electromagnetically operates both the direction control valve 106 and one of the control valves 108, 110, 112, or 114. The direction control valve 106 directs hydraulic fluid flow according to the direction toward which the selected switch is operated. A combination lock valve 116 including a check valve and a relief valve operated by pilot hydraulic fluid pressure from the rod end of the cylinder and piston assembly 54 (for opening the outer load-carrying arm 44), prevents inadvertent opening movement of the load-carrying arm 44, since it supports the weight of an object during rotation or when the cradle is stopped in the position shown in FIGS. 3 and 4. Additionally, since the control valves 108, 110, 112, and 114 are biased to be closed, loss of electrical control voltage or hydraulic supply pressure does not result in an unsafe condition. With the valves 108, 110, 112, and 114 closed a load will be held stationary.

Double-pole double-throw limit switches 117 and 118 are included in the electrical circuit which controls the solenoid-operated valves 112 and 114. A normally-open side of each limit switch presents an open circuit to the solenoid valves 112 and 114 and thus prevents actuation of the hydraulic cylinder and piston assemblies 50 and 54, respectively, unless the main carrier 36 is located in either of two predetermined limiting positions. The limit switches 117 and 118 thus prevent the load-carrying arms 42 and 44 from pivoting relative to the central carrier 36, except when the central carrier 36 is in either the upright position shown in FIG. 3 or the inverted position shown in FIG. 1. This assures that a load will not be dropped accidentally as a result of operator error while a cargo container chassis is being turned over, or as a result of loss of hydraulic fluid pressure. A normally-closed side of each of the limit switches 117 and 118 disconnects the elecrical current from the pilot selector valve 106 and thus stops movement of the main carrier 36 as it reaches each limiting position, thus preventing damage to the hydraulic motor 98 and the mechanical drive train of the main carrier 36. A pair of resilient positive stops 120 and 121 eliminate free play from the drive train and cushion the stopping of the main carrier 36.

A flow-limiting restrictor 122, a check valve 124, and a pressure-limiting cross-port relief valve unit 126 are located in the hydraulic fluid conduits between the solenoid operated valve 108 and the bidirectional rotary hydraulic motor 96, to protect the motor 96 from overspeeding as the central carrier 36 is rotated downward to the inverted position.

Where it is desired to use the apparatus 20 on vehicles which have the required lifting ability but can not provide a sufficient supply of hydraulic fluid under pressure to operate the apparatus, it may be desirable to provide an auxiliary engine such as a small internal combustion engine 127 (FIG. 2), located on the frame of the apparatus 20 and equipped to drive a hydraulic fluid pump system. In such an installation, one of the longitudinal frame members 24 and 26 may be used as a hydraulic fluid reservoir.

OPERATION

Figure 6:
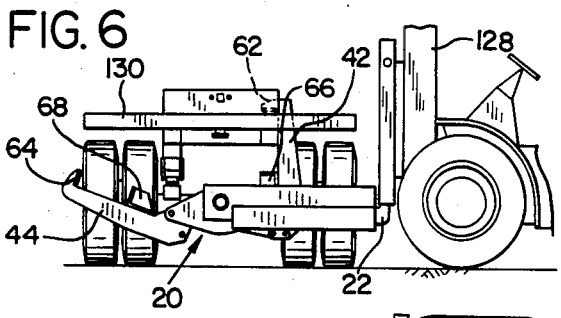
FIG. 6 is a left side elevational view, at a reduced scale, of the apparatus shown in FIG. 1 mounted on a heavy-duty forklift vehicle, showing the outer one of the load-carrying arms in the lowered or open position to facilitate placing the apparatus in position for grasping the frame of a cargo container chassis.
Figure 7:
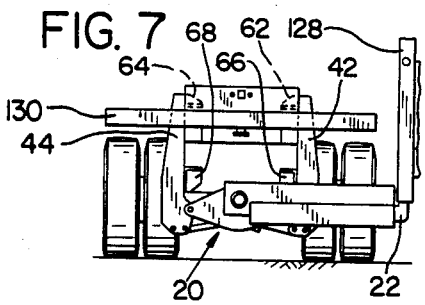
FIG. 7 is a left side elevational view of the apparatus shown in FIG. 6 showing both load-carrying arms in their closed, load-carrying positions.

The apparatus 20 of the present invention is carried on a lift truck 128 as shown in FIGS. 6–10 to raise, turn, and lower a large elongate object such as a cargo container chassis 130. As shown in FIG. 6, the central carrier 36 is in its fully upright position, and limit switch 118 is closed. The control switch 104 has been held closed in the appropriate direction, operating the pilot valve 106 and the solenoid valve 114 as the outer load-carrying arm 44 is pivoted to its lowered, or open, position. The chassis-handling apparatus 20 has been placed in a position clear of the ground yet low enough for the arm 44 to pass beneath the longitudinal frame members of the chassis 130, by appropriately locating the vertically movable portion of the lift truck 128. The forklift vehicle 128 to which the apparatus 20 is attached has been moved forward to place the apparatus 20 beneath the main longitudinal frame members of the chassis 130 with the outer load-carrying arm 44 in its lowered position.

Figure 8:
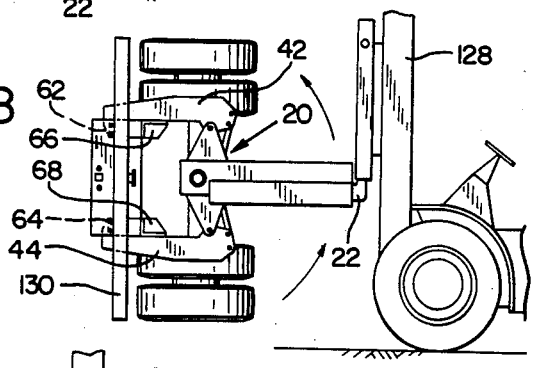
FIG. 8 is a left side elevational view of the forklift vehicle and chassis handling apparatus shown in FIGS. 6 and 7, with a cargo container chassis carried therein and the cradle rotated to the intermediate position shown in FIG. 3.

With the chassis-handling apparatus 20 beneath the chassis 130, the apparatus 20 is raised, if necessary, to place the fixed jaw 62 above the top of the right-hand main longitudinal frame member of the chassis 130, bringing the main carrier 36 adjacent the bottom of the main longitudinal frame members of the chassis 130. By closing the switch 104 in the appropriate direction, the outer load-carrying arm 44 is then pivoted to its upwardly-extending, closed position, shown in FIG. 7, in which it is parallel with the inner load-carrying arm 42. Next, the vertically movable portion of the forklift vehicle 128 is lowered as required to bring the outer, fixed jaws 62 and 64 into contact with the upper surfaces of the longitudinal frame members of the chassis 130. Thereafter, switch 102 is closed in the appropriate direction, so that the movable jaws 66 and 68 are raised to their upper or closed positions as shown in FIG. 8, adjacent the lower surfaces of the longitudinal frame members of the chassis 130. At this time the vertically movable load-carrying portion of the forklift vehicle 128 is raised, raising the apparatus 20 and lifting the chassis 130 vertically clear of the ground.

Figure 10:
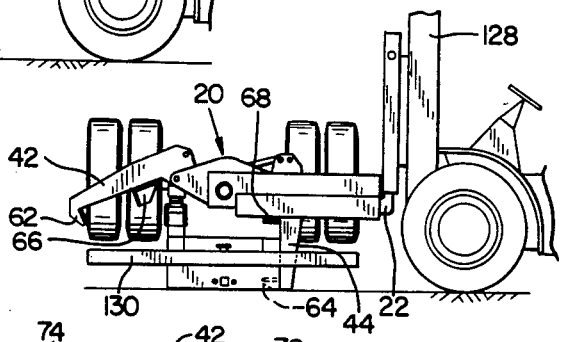
FIG. 10 is a left side elevational view of the apparatus and forklift vehicle shown in FIGS. 6–9, with the inner load-carrying arm pivoted to a raised position providing clearance for removal of the apparatus from the inverted container chassis.
Figure 9:
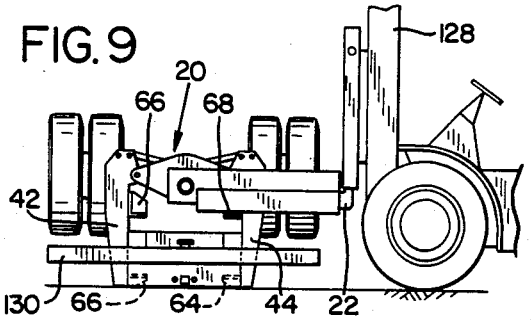
FIG. 9 is a left side elevational view of the fork lift vehicle and chassis handling apparatus shown in FIGS. 6–8, with the cargo container chassis lowered to the ground in an inverted position.

By operating the switch 100 in the appropriate direction the operator causes the hydraulic motor 96 to rotate, thus rotating the reduction gear assembly 94 and the pinion 40, to move the central carrier 36 and overturn the chassis 130 by interaction of the pinion 40 with the sector gear 38. As the main carrier 36 approaches the position shown in FIG. 9, it actuates the limit switch 118 which opens the circuit to the solenoid-operated hydraulic fluid direction control valve 106, stopping the main carrier 36 and permitting the solenoid valve 112 to be actuated by the switch 104 to pivot the load-carrying arm 42 upward and outward to the open position shown in FIG. 10. Before the load-carrying arm 42 is moved, however, the operator moves lift truck 128 and raises or lowers the chassis 130 to the desired location. This is facilitated, of course, if the lift truck 128 is equipped with a side-shifter mechanism to permit the chassis 130 to be placed easily where desired relative to the length of the top chassis already in a stack. When the chassis 130 has been lowered in the inverted attitude to rest upon the ground (or upon the top of a similar but upright chassis in a stack) the switch 102 is operated, opening solenoid valve 110, and the cylinder and piston assemblies 74 and 76 then retract the movable jaws 66 and 68 from the frame members of the chassis 130. The inner load-carrying arm 42 may then be pivoted to its raised position by operation of switch 104, operating solenoid valve 112 (but only if the main carrier 36 is in the fully inverted position, closing limit switch 118). When the solenoid operated valve 112 opens, the cylinder and piston assembly 50 is actuated to move the inner load-carrying arm to its raised, open position, free of the longitudinal frame member of the chassis 130, as shown in FIG. 10. This permits the load-carrying arms 22 to be raised and the forklift vehicle to be backed away from the chassis 130.

The speed of operation of the various cylinder and piston assemblies and of the hydraulic motor 96 is controlled by controlling the source 98 of pressurized fluid. Additionally, the flow restrictor 120 prevents the motor 96 from overspeeding while operating in the direction lowering the central carrier 36 and its load. The hydraulic motor 96 is protected from being overloaded or from overstressing the reduction gear assembly 94 by the pressure relief valves 126, which are set to provide sufficient pressure to the hydraulic motor 96 for moving the loads anticipated.

The apparatus 20 of the present invention is easily mounted on or removed from such a lift truck 128, since it is carried principally by the forklift arms 22 of the forklift vehicle. Mounting requires only simply effected connection into the hydraulic fluid pressure system of the forklift vehicle 128, and attachment of safety chains or the like to prevent the chassis-handling apparatus 20 from inadvertently sliding off the forklift arms 22. The control switches 100, 102, and 104 may be mounted permanently on a forklift vehicle 128 with which the apparatus 20 is to be used, with appropriate detachable connections being provided at a convenient location along a cable from the switches to the electrical circuits within the apparatus 20 which are controlled by these switches. Because of the simplicity and speed with which the apparatus 20 may be mounted on a forklift vehicle, a forklift vehicle need not be permanently utilized for operation of the chassis-handling apparatus 20, but remains available for use in performing other tasks, except when it is actually in use handling chassis.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of handling cargo container trailer chassis of the type having a pair of longitudinal chassis frame members supported by road wheels and used to carry detachable intermodal cargo containers, for stacking and unstacking said trailer chassis upon one another, comprising:

(a) providing a chassis-turning apparatus including a rotatable portion having attached pivotably thereto a pair of load-carrying arms;

(b) pivoting a first one of said arms relatively to the other, to a generally horizontally-extending open position wherein said first one of said arms which has been pivoted has a reduced vertical height, and thereafter moving said rotatable portion into position for grasping a trailer chassis, by placing said rotatable portion of said chassis turning apparatus adjacent a bottom side of said longitudinal chassis frame members of a trailer chassis while said first one of said arms is in said open position;

(c) pivoting said first one of said arms about a pivot axis located generally parallel with the length of said longitudinal chassis frame members, to a closed positions, thereby grasping said pair of longitudinal chassis frame members between said pair of load-carrying arms;

(d) raising said rotatable portion, together with said pair of load-carrying arms and said trailer chassis;

(e) rotating said rotatable portion, together with said pair of arms and said trailer chassis, approximately 180 degrees about a horizontal axis of rotation located generally parallel with the length of said longitudinal chassis frame members of said trailer chassis, while holding said pair of arms and said trailer chassis at a height sufficient to clear any obstruction to said rotation;

(f) thereafter lowering said rotatable portion, together with said pair of arms and asid trailer chassis, until said trailer chassis rests in a desired location; and (g) thereafter pivoting the other one of said load-carrying arms away from said longitudinal chassis frame members of said trailer chassis, about a respective pivot axis located generally parallel with the length of said longitudinal chassis frame members, to an open position, thereby releasing said longitudinal chassis frame members from between said pair of load-carrying arms.

2. The method of claim 1, including following step (e), the additional step of placing said trailer chassis atop a stack containing at least one of said trailer chassis, a bottom trailer chassis of said stack being upright, and any additional trailer chassis being stacked atop said bottom trailer chassis in alternatingly upright and inverted orientation.

3. The method of claim 1, including the step of inserting said first one of said pair of load-carrying arms of said chassis-turning apparatus beneath the longitudinal chassis frame members of a trailer chassis by moving said apparatus toward said trailer chassis in a direction transverse to the length of said trailer chassis when said trailer chassis is in an upright position, and releasing said longitudinal frame members of said trailer chassis when said tailer chassis is in an inverted position.

4. Apparatus attachable to a vehicle having a vertically movable lifting apparatus at one end thereof, for use in stacking and unstacking trailer chassis of the type used to carry detachable intermodal cargo containers and having laterally spaced-apart chassis frame longitudinal members supported by road wheels, said apparatus comprising:

(a) a frame attachable to a portion of said lifting apparatus so as to be selectively raised and lowered by said lifting apparatus;

(b) means supported by said frame for defining a main carrier axis of rotation extending horizontally and transversely with respect to said frame;

(c) a main carrier supported by said frame and rotatable about said main carrier axis of rotation, between respective upright and inverted positions;

(d) means located on said main carrier for defining a pair of parallel carrying-arm pivot axes extending horizontally and transversely with respect to said frame, said carrying-arm pivot axes being spaced apart from one another and being located on opposite sides of an imaginary vertical plane including said main carrier axis of rotation when said main carrier in in either of said upright and inverted positions;

(e) first and second load-carrying arms, each attached pivotably to said main carrier and each being pivotable about a respective one of said carrying-arm pivot axes, between a respective load-carrying position and a respective open position, both of said load-carrying arms extending upwardly from said main carrier when said load-carrying arms are in their respective load-carrying positions and said main carrier is in said upright position, and both of said load-carrying arms extending downwardly from said main carrier when said load-carrying arms are in their respective load-carrying positions and said main carrier is in said inverted position; and (f) first motor means operatively connected with said main carrier for rotating said main carrier about said main carrier axis of rotation, between said upright position and said inverted position.

5. The apparatus of claim 4 wherein said first load-carrying arm extends generally horizontally when in said open position, said first load-carrying arm being small enough to be inserted beneath said longitudinal chassis frame members of an upright one of said trailer chassis located on level ground when said first load-carrying arm is in said open position.

6. The apparatus of claim 4, wherein each of said load-carrying arms includes an outer end and has a first jaw located at said outer end and a second jaw located intermediate said outer end and said main carrier and movable along said load-carrying arm toward and away from said first jaw.

7. The apparatus of claim 4, each of said load-carrying arms further including motor means operatively connected between said one of said load-carrying arms and the respective second jaw thereof for moving said second jaw toward and away from said first jaw thereof.

8. The apparatus of claim 4 including respective motor means associated with each of said load-carrying arms for pivoting the respective load-carrying arm with respect to said main carrier.

9. The apparatus of claim 4, further including position-sensing means responsive to the position of said main carrier, for preventing said load-carrying arms from pivoting with respect to said main carrier except when said main carrier is in either said upright position or said inverted position.

10. The apparatus of claim 4, including an integral power source carried on said frame, said power source having means for providing power for pivoting said load-carrying arms with respect to said main carrier and for rotating said main carrier with respect to said frame.

11. The apparatus of claim 4 including carrying-arm motor means for selectively moving said first and second load-carrying arms, and limiting means responsive to the position of said main carrier for controlling operation of said carrying-arm motor means, said limiting means preventing said first load-carrying arm from being pivotable away from its respective load-carrying position except in response to said main carrier being in said upright position and preventing said seocnd load-carrying arm from being pivotable away from its respective load-carrying position except in response to said main carrier being in said inverted position.

12. The apparatus of claim 4, wherein said vehicle having a movable lifting apparatus is a fork lift vehicle, and wherein said frame includes a pair of longitudinal members located on respective opposite sides of said frame and includes means associated with said longitudinal members for receiving respective fork members of said movable lifting apparatus to support said frame with respect to said movable lifting apparatus.

* * * * *

UNITED STATES PATENT AND TRADEMARK OFFICE

CERTIFICATE OF CORRECTION

PATENT NO. : 4,664,576

DATED : May 12, 1987

INVENTOR(S) : Donald R. Coe

It is certified that error appears in the above-identified patent and that said Letters Patent is hereby corrected as shown below:

Col. 11, Line 16 Change "4" to --6--.

Signed and Sealed this

Twentieth Day of September, 1988

*Attest:*

DONALD J. QUIGG

*Attesting Officer*

*Commissioner of Patents and Trademarks*